US009782875B2

(12) United States Patent
Arnold

(10) Patent No.: US 9,782,875 B2
(45) Date of Patent: Oct. 10, 2017

(54) METHOD OF INSTALLING LIGHT FIXTURE

(71) Applicant: Bruce Young Arnold, Cambridge, MA (US)

(72) Inventor: Bruce Young Arnold, Cambridge, MA (US)

( * ) Notice: Subject to any disclaimer, the term of this patent is extended or adjusted under 35 U.S.C. 154(b) by 115 days.

(21) Appl. No.: 14/738,845

(22) Filed: Jun. 13, 2015

(65) Prior Publication Data

US 2016/0363278 A1 Dec. 15, 2016

(51) Int. Cl.

| | |
|---|---|
| ***B25B 15/00*** | (2006.01) |
| ***F21S 8/00*** | (2006.01) |
| ***F21V 21/10*** | (2006.01) |
| ***F21V 23/00*** | (2015.01) |
| ***F21S 8/04*** | (2006.01) |
| ***F21V 3/00*** | (2015.01) |
| ***F21V 21/03*** | (2006.01) |

(52) U.S. Cl.

CPC ..... *B25B 15/002* (2013.01); *F21S 8/036* (2013.01); *F21S 8/04* (2013.01); *F21V 3/00* (2013.01); *F21V 21/03* (2013.01); *F21V 21/10* (2013.01); *F21V 23/008* (2013.01)

(58) Field of Classification Search

CPC ..... F21S 8/03; F21S 8/04; F21S 8/043; F21S 8/046; F21S 13/02; F21V 17/12; F21V 17/14; F21V 19/006; F21V 21/02; F21V 21/03; F21V 21/025; F21V 21/047; F21V 21/048; F21V 21/049; F21V 29/15

See application file for complete search history.

(56) References Cited

U.S. PATENT DOCUMENTS

| | | | | |
|---|---|---|---|---|
| 5,074,173 | A | 12/1991 | Cearley | |
| 5,317,493 | A * | 5/1994 | Muller | F21S 2/00 362/403 |
| 5,434,356 | A * | 7/1995 | Zekowski | F04D 25/088 174/481 |
| 8,057,077 | B2 * | 11/2011 | Gagne | F21V 21/02 362/147 |
| 2004/0218396 | A1 * | 11/2004 | Garber | F21V 23/00 362/432 |
| 2004/0246708 | A1 * | 12/2004 | Wu | F21V 21/02 362/147 |
| 2004/0246729 | A1 * | 12/2004 | Wu | F21V 21/02 362/406 |
| 2006/0285357 | A1 * | 12/2006 | Shyu | F21S 8/04 362/611 |

(Continued)

*Primary Examiner* — Christopher M Koehler

(74) *Attorney, Agent, or Firm* — Bruce Y Arnold

(57) ABSTRACT

A method of installing a light fixture base to a surface is disclosed that employs an elongated tool that engages a mounting screw in rough alignment with an axis of the elongated member. The mounting screw and elongated tool are inserted through a mounting hole in the base and moved upward through thermal insulation in the base. The elongated tool is then manipulated while viewing both a tip end of the mounting screw and a threaded hole in a mounting bracket attached to a junction box so as to attach the mounting screw to the mounting bracket. The elongated tool then serves as a guide while sliding the base upward along the elongated tool so as to rapidly attach the base to a mounting screw in the mounting bracket.

1 Claim, 4 Drawing Sheets

(56) References Cited

U.S. PATENT DOCUMENTS

| | | | | |
|---|---|---|---|---|
| 2012/0266449 | A1* | 10/2012 | Krupa | F21S 8/043<br>29/592.1 |
| 2013/0016504 | A1* | 1/2013 | Garber | F21V 21/02<br>362/217.16 |

* cited by examiner

FIG. 1

Step (a)

insert an elongated tool, having a hollow portion at one end and a head of a mounting screw frictionally engaged by the hollow portion and with a tip end of the mounting screw extending outside the hollow portion, through a mounting hole in a base of a light fixture that is to be mounted to a support bracket of a junction box, as well as through a thermal insulation contained in the base until the tip end of the mounting screw emerges above the thermal insulation Step (b)

while viewing both the tip end of the mounting screw and the support bracket, manipulate the elongated tool so as to insert the tip end within a threaded hole of the support bracket Step (c)

rotate the elongated tool so that the mounting screw engages the threaded hole

Step (d)

slide the base up along the elongated tool until the mounting hole of the base is above the head of the mounting screw, the base having a mounting slot contiguous to the mounting hole that is larger in width than a shaft portion of the mounting screw but smaller than the head of the mounting screw Step (e)

move the base so that the shaft portion of the mounting screw enters the mounting slot

METHOD OF INSTALLING LIGHT FIXTURE

BACKGROUND OF THE INVENTION

The present invention drastically reduces the amount of time needed to install a so-called "flushmount" light fixture to a junction box, as compared to the conventional method (e.g., as contained in mounting instructions for flushmount light fixtures manufactured by HAMPTON BAY). The present invention should apply as well when installing flushmount light fixtures of similar design that are made by other manufacturers, such as COMMERCIAL ELECTRIC, PROGRESS LIGHTING, DESIGNERS FOUNTAIN, WESTINGHOUSE, and others). A flushmount light fixture is defined herein as a light fixture which, when mounted, a base portion of the light fixture contacts or is immediately adjacent the surface to which the light fixture is mounted. Most often, these light fixtures are mounted so that a base portion of the light fixture contacts the ceiling.

Typically, installation hardware as well as installation instructions are supplied in the shipping box of the light fixture. Often the installation hardware includes a mounting bracket for attachment to a junction box, two pairs of machine screws, and electrical connectors. The installation instructions describe a conventional method of installing a light fixture in which the installer is directed to screw, into threaded holes in the mounting bracket, mounting screws that later will be used to secure the base of the light fixture against or immediately adjacent the ceiling. These mounting screws are typically longer than the other pair of machine screws that are intended for use in attaching the mounting bracket to the junction box. It is not critical whether the mounting screws are installed into the mounting bracket before or after the mounting bracket is secured to the junction box. Once those two steps are completed, the mounting screws extend downward from the mounting bracket, with their heads lower-most. Next in the conventional method, a grounding wire of the light fixture base is attached to a grounding screw on the bracket, and the light fixture base is temporarily supported by that grounding wire so as to allow the installer to use both hands when making electrical connections. After the electrical connections have been made (that connect wires in the junction box to wires in the light fixture), the next conventional step is to raise the light fixture until the heads of the mounting screws pass through holes in the base of the light fixture.

In addition to the two mounting holes in the light fixture base, each of these mounting holes has a mounting slot contiguous thereto of a width smaller than the diameter of the mounting holes in the base. The width of the mounting slots is slightly larger than the width of the shaft portion of the mounting screws, but smaller than that of the heads of the mounting screws, and the diameter of each mounting hole is slightly larger than the heads of the mounting screws. After the heads of the mounting screws have passed through the mounting holes as a result of the installer raising the base, conventional installation instructions direct that the base be moved (e.g., by rotation or sliding) so that the mounting screws engage the slots. The mounting instructions then direct that the mounting screws be tightened.

There are several problems with the above-discussed, conventional method(s) of mounting a light fixture.

A first problem is flushmount light fixtures usually have thermal insulation installed in the base of the light fixture. This insulation lies above the portion of the base having the mounting holes and slots. Most often, the base is made of sheet metal, and the insulation serves to protect the ceiling from the heat of the light bulbs that are to be installed in the light fixture below the base. Unfortunately during installation of the base, when viewing is attempted from above the base, this insulation blocks the view of the installer from being able to see the mounting holes—thus making it extremely difficult to (essentially blindly) align the mounting holes of the light fixture with the heads of the mounting screws when raising the base. And, when the installer attempts to view from below the base, the insulation in the base makes it very difficult to see the heads of the mounting screws that are mounted to the support bracket. Thus, the installer must use trail-and-error while blindly attempting to raise the base so that the heads of the mounting screws pass through the mounting holes of the base. Moreover, when raising the base, the thermal insulation that is contacted by the heads of the mounting screws tends to be sheared-off. This material, which is irritating to the skin and eyes of an installer, often falls onto the face of an installer attempting to peer through one or more of these mounting holes in the base (and the inch or more of insulation) so as to align the mounting hole(s) with the head(s) of the mounting screw(s). If this insulation is removed from the base, the light fixture no longer complies with the electric code and the risk of fire is increased.

A second problem is raising the base as per the conventional installation method(s) may never achieve the desired result of passing the heads of both mounting screws simultaneously through their respective mounting holes in the base. Due to manufacturing tolerances, it is often the case that the two mounting screws when threaded into the mounting bracket are not in parallel alignment. When this occurs, despite the number of times the base is raised, both mounting screw heads will not simultaneously align with the mounting holes in the base until a lateral force has been applied to at least one of the two mounting screws installed in the mounting bracket. As mentioned above, because the installer is operating in an essentially blind manner, the direction in which a lateral force should be applied is unknown to the installer.

A third problem is the thermal insulation is often thicker than the base. Thus, when the base is raised to the point that a head of a mounting screw passes through a mounting hole, the insulation in the base contacts the ceiling and exerts a small bias force in the downward direction on the base. This bias makes it difficult to maintain the head of a first mounting screw in the state of being passed-through its mounting hole while working to get the head of the second mounting screw passed-through its mounting hole. Thus, once the installer blindly succeeds in getting a first mounting screw head through a mounting screw hole in the base, he must then blindly get the second mounting screw through a different mounting hole in the base. While attempting this, the installer must continuously keep the base pressed upward against the ceiling. Otherwise, because the base is biased downward by the insulation as well as gravity, the first mounting screw easily passes back through its mounting hole (i.e., upward relative to the base) and disappears from view. After this occurs once or twice, the installer is motivated to deviate from the mounting instructions supplied with the light fixture and secure the first mounting screw into its respective mounting slot, and then to tighten the mounting screw somewhat so as to hold it in place. However, moving the base so that the shaft of the first mounting screw engages its respective slot generally misaligns the base from from having the second mounting screw be in alignment with the second mounting hole of the base. In this situation, it becomes necessary to apply a lateral force to the second installation screw so as to achieve alignment of its head with that of the second mounting hole in the base. However, because it is very difficult for the installer to simultaneously view both the mounting screw head and the mounting hole in the base when raising the base (as discussed above), the direction this lateral force must be applied for alignment is very difficult for the installer to determine.

A fourth problem is the act of tightening a first mounting screw head against a slot in the base causes the material of the base, which often is either sheet metal or molded plastic, to deflect somewhat from being planar in the region near the head of the mounting screw. This deflection often results in a force component developing on the base that causes the base to move. More specifically, as the mounting screw is tightened against the slot, a force component often develops that causes the mounting screw to move along the slot in the direction of the mounting hole. Thus, before tightening the head of the mounting screw against the slot, it is prudent for the installer to block the mounting hole so as to prevent the mounting screw from re-entering that space and disappearing from view.

OBJECTS AND SUMMARY OF THE INVENTION

It is a first object of the invention to provide an easier method of installing a flushmount light fixture that avoids the problems mentioned above, and that allows the light fixture to be installed in a small fraction of the time otherwise required.

In the event a mounting bracket supplied with a light fixture has multiple pairs of threaded holes (e.g., when the mounting bracket has been manufactured for shipping with two styles of light fixtures having different distances between the mounting holes in the base), a second object of the invention is to prevent the mounting screw(s) from being inadvertently threaded into holes of the mounting bracket not intended for use with the style of light fixture that was purchased. The present method makes it readily apparent to the installer which threaded holes in the mounting bracket are the appropriate ones to use when installing the base.

BRIEF DESCRIPTION OF THE DRAWINGS

FIG. 1 shows the method steps (a)-(e) of the present invention.

FIG. 9 also illustrates the elongated tool shown in FIG. 2 when being used to install the base of a light fixture, which supports a thermal insulation, to a mounting bracket at the point in time: (a) after the elongated tool has been used to mount the mounting screw into a threaded hole in mounting bracket; (b) after the base has been raised along the elongated tool to a point where the mounting hole and its contiguous slot in the base are above the head of the mounting screw; and (c) after the base has been moved so that the elongated tool and shaft of the mounting screw enter that contiguous slot.

DETAILED DESCRIPTION OF THE INVENTION

FIG. 1 illustrates the steps (a)-(e) of the method of installing a light fixture according to the present invention.

Figure 2:
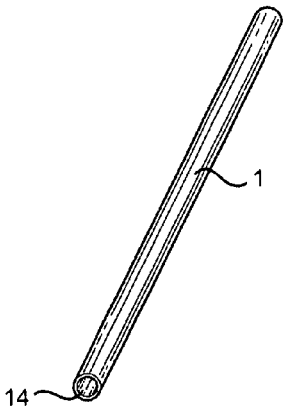
FIG. 2 illustrates an elongated tool that is used in the installation method of the present invention.

FIG. 2 illustrates an elongated tool 1, having a hollow end portion 14, at one end that is used in the installation method of the present invention.

Figure 3:
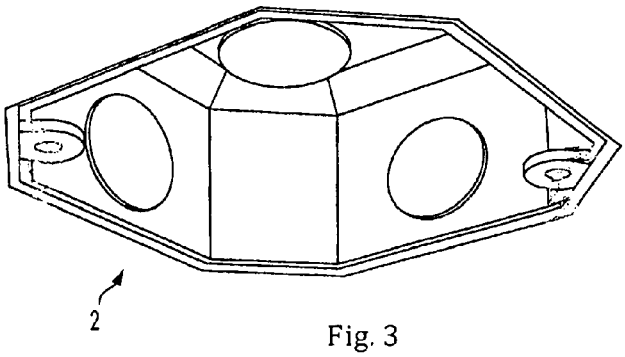
FIG. 3 illustrates a conventional electrical junction box when mounted within an octagonal opening in a surface, such as a ceiling.

FIG. 3 illustrates a conventional electrical junction box 2 when mounted within an octagonal opening in a surface, such as a ceiling. (For clarity of illustration the electrical wiring of the junction box has been omitted from the figure.)

Figure 4:
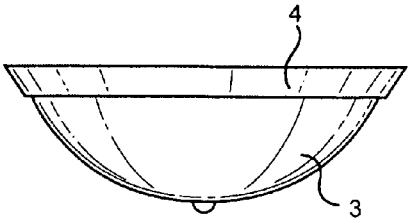
FIG. 4 illustrates a conventional light fixture (that includes a globe and a base) that is to be mounted to a surface by attaching the base to the junction box shown in FIG. 3.
Figure 5:
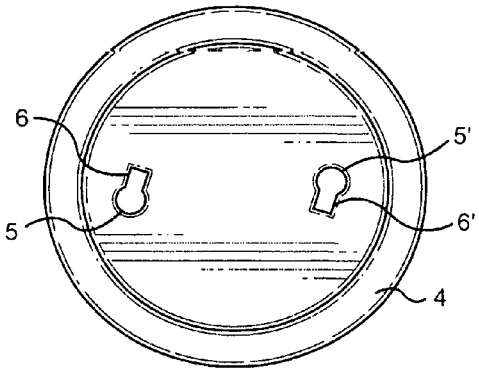
FIG. 5 illustrates two mounting holes, each with a slot contiguous thereto, that are in the base of the light fixture shown in FIG. 3 (as viewed from below, without the globe).

FIG. 4 illustrates a conventional light fixture, including a globe 3 and a base 4, that is to be mounted to a surface by attaching the base shown in FIG. 5 to the junction box shown in FIG. 3.

FIG. 5 illustrates two mounting holes 5 and 5' in the base 4, each with a respective slot 6 and 6' contiguous thereto, as viewed from below the base, without the globe.

Figure 6:
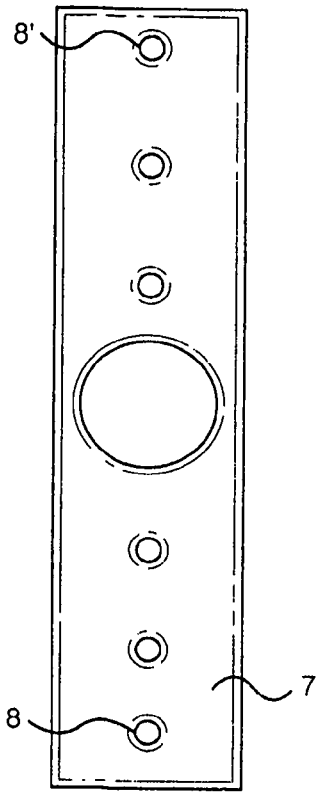
FIG. 6 illustrates a conventional mounting bracket, with threaded holes therein, that is used to mount a light fixture to the electrical junction box shown in FIG. 3.

FIG. 6 illustrates a conventional mounting bracket 7, with multiple pairs 8, 8' of threaded holes therein.

Figure 7:
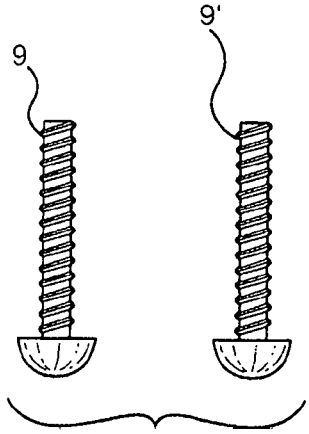
FIG. 7 illustrates a pair of conventional machine screws that are used to attach the mounting bracket shown in FIG. 6 to the electrical junction box shown in FIG. 3 (using the outermost threaded holes shown in FIG. 6).

FIG. 7 illustrates a pair of conventional machine screws 9, 9' that are used to attach the mounting bracket shown in FIG. 6 to the electrical junction box shown in FIG. 3 using the outermost pair of threaded holes 8, 8' shown in FIG. 6.

Figure 8:
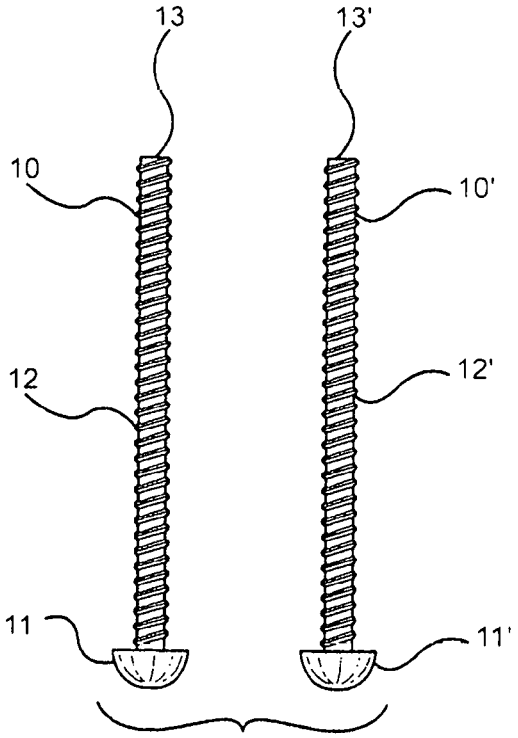
FIG. 8 illustrates a pair of conventional machine screws that are used to mount the base of the light fixture shown in FIG. 5 to the conventional mounting bracket shown in FIG. 6.

FIG. 8 illustrates a pair of conventional machine screws 10, 10' having heads 11, 11' shafts 12, 12' and tip ends 13, 13' that are used to mount the base of the light fixture shown in FIG. 5 to the conventional mounting bracket shown in FIG. 6. So as to enable the mounting bracket to accommodate different styles of light fixtures, it is not uncommon for the mounting bracket to include two pairs of threaded holes for mounting the base, but only a single pair is used for mounting a given style of light fixture.

Figure 9:
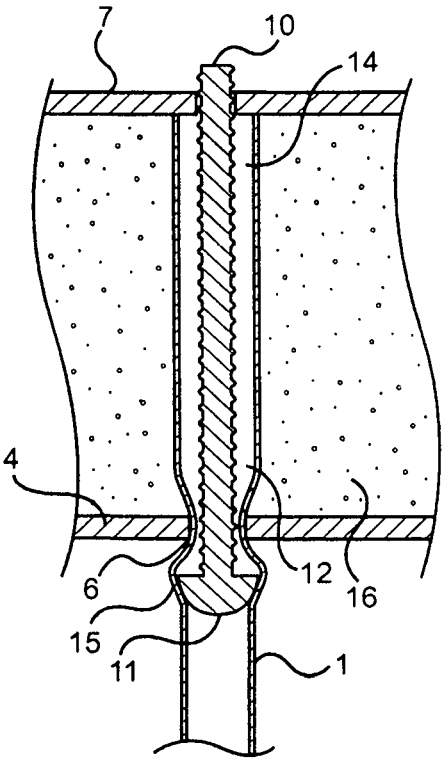
FIG. 9 is a vertical cross-sectional view of a hollow end portion of an elongated tool that frictionally engages a head of mounting screw in a region of the elongated tool where the head has caused the hollow end portion to expand due to the head being larger than the hollow end portion.

FIG. 9 is a vertical cross-sectional view (corresponding roughly to actual size) of a hollow end portion 14 of an elongated tool 1 that frictionally engages a head 11 of mounting screw 10 in a region 15 of the elongated tool where the head has caused the hollow end portion to expand due to the head being larger than the hollow end portion. FIG. 9 also illustrates the elongated tool when being used to install the base 4 of a light fixture, that supports a thermal insulation 16, to a mounting bracket 7 at the point in time: (a) after the mounting tool has been used to mount the mounting screw into a threaded hole in the mounting bracket 14; (b) after the base has been raised along the elongated tool to a point where a slot 6 in the base is above the head of the mounting screw; and (c) after the base has been moved so that both the elongated tool 1 and the shaft 12 of the mounting screw have entered the slot 6.

Figure 10:
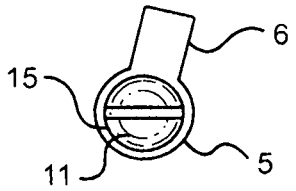
FIG. 10 is an enlarged view (corresponding roughly to actual size) of the mounting hole and contiguous slot in the base that are illustrated in the left part of FIG. 5. This figure shows an expanded portion of the elongated tool and the head of a frictionally engaged mounting screw as they pass through a mounting hole in the base, as viewed from below the base. This situation occurs both before each mounting screw has been mounted to the mounting bracket as well as afterwards.

FIG. 10 is an enlarged view (corresponding roughly to actual size) of the mounting hole 5 and contiguous slot 6 illustrated in FIG. 5. This figure also shows, from a viewpoint directly below the mounting hole in the base, an expanded portion 15 of the elongated tool and the head 11 of a frictionally engaged mounting screw as they pass through the mounting hole. This situation occurs both before and after each mounting screw shown in FIG. 8 has been attached to the mounting bracket. The first occurrence is after the elongated tool with a frictionally engaged mounting screw has been inserted into hole in the base from below and is being manipulated upward through a thermal insulation that is supported by the base, as well as after that mounting screw has been mounted to the mounting bracket and the base is raised upward along the elongated tool.

Figure 11:
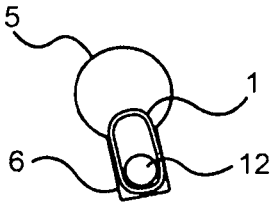
FIG. 11 shows the same mounting hole and mounting slot in the base as illustrated in FIG. 10, but from a viewpoint above the base and at a point in time: (a) after the mounting screw has been mounted to the mounting bracket; (b) after the base has been raised along the elongated tool until the head of the mounting screw has passed below the mounting hole in the base; and (c) after the base has then been moved so that the shaft of the mounting screw has entered the mounting slot in the base that is contiguous to that mounting hole.

FIG. 11 shows (from a hypothetical viewpoint directly above the mounting slot 6 that assumes both the mounting bracket 7 of FIG. 9 and the thermal insulation 16 of FIG. 9 are invisible) the same mounting hole 5 and mounting slot 6 illustrated in FIG. 10. The orientation of the mounting slot relative to the mounting hole is different due to the viewing direction of FIG. 10 being upward versus that of FIG. 11 being downward. FIGS. 9 and 11 illustrate the interaction of components at a point in time: (a) after the mounting screw has been mounted to the mounting bracket; (b) after the base has been raised along the elongated tool until the head of the mounting screw has passed below the mounting hole; and (c) after the base has been moved so that the shaft 12 of the mounting screw has entered the mounting slot 6 by the installer moving the base.

Rather than installing the mounting screws in the mounting bracket with their heads lowermost, and then raising the base so that the mounting screw heads pass though mounting holes in the base, the present invention avoids these two steps.

According to the preferred embodiment of the present invention, once the electrical connections have been made, a first mounting screw is inserted, head-first, into an elongated tool that is hollow at one end. The elongated tool frictionally engages the head of the mounting screw and keeps its shaft in rough alignment with an axis of the elongated tool, leaving about ⅛" of the shaft of the mounting screw sticking out from the elongated tool. The elongated tool is of a size that allows it (and the head of the mounting screw inserted within) to pass upward through the mounting hole of the base, and is of a length as to allow the installer (while holding the elongated tool from below the base), to manipulate the mounting screw's tip end into an appropriate threaded hole of the mounting bracket. This last-mentioned task is performed while viewing the base with the installer's eyes above the base. Thus, both the mounting screw's tip end and the threaded hole(s) in the mounting bracket are visible to the installer. Prior to this, while viewing from below the base, the tool with inserted mounting screw is guided by the installer into the mounting hole of the base and pushed upward through a hole or aperture in the insulation.

The installer then changes his view, (e.g., by standing higher on a ladder) so that the screw tip and the mounting hole(s) in the bracket are visible and takes the following actions:

(a) using the elongated tool, the installer guides the first mounting screw into an appropriate threaded mounting hole of the bracket, and rotates the elongated tool until the first mounting screw is secured in that mounting hole;

(b) the base is raised by sliding it along the elongated tool, with the elongated tool serving as a guide, until the head of the first mounting screw engaged by the elongated tool passes through the mounting hole in the base;

(c) the base is moved so that the elongated tool and shaft of the first mounting screw enter the contiguous mounting slot in the base;

(d) the elongated tool is disengaged from the first mounting screw by pulling sharply downward on the elongated tool; and (e) the elongated tool is inserted once more into the same mounting hole of the base as before, so as to block the first mounting screw from re-occupying that space;

The first mounting screw may be left as is, partially tightened, or fully tightened prior to the installer beginning work pertaining to a second mounting screw so as to mount the base more securely than when a single mounting screw employed.

If the first mounting screw has been fully tightened so as to make the light fixture snug against the ceiling on one side of the base, the elongated tool can be removed from its blocking position and the above-mentioned process repeated for the second mounting screw using the same elongated tool. However, fully tightening the first mounting screw is not recommended, as the base will be more difficult to move when aligning the base to accept the second mounting screw through a second mounting hole.

If the first mounting screw has not been fully tightened, it is prudent to leave the elongated tool in its blocking position, and to use a second elongated tool, similar in shape and size to the first elongated tool, during the remainder of the installation process. Using two elongated tools as opposed to one is advantageous in that the second mounting screw may be initially screwed into the mounting bracket with there being additional space between the ceiling and the base, since the first mounting screw has not been tightened or has been only partially tightened. If a lateral force is needed in order to get the second mounting screw to align with a threaded hole in the mounting bracket (as is usually the case), it will be easier to install the base to the mounting bracket as a result of that extra space.

Once the second mounting screw has been inserted into an appropriate threaded hole in the mounting bracket and then rotated by a second elongated tool so that the threads of its engaged mounting screw engage the threads of that threaded hole, the light fixture base up can be slid upward along that elongated tool. Just as before, when sliding the base upward, the elongated tool occupies the space of the mounting hole in which it was first inserted, and thus guides the base to be in alignment so that the head of the mounted screw will pass through the mounting hole in the base once the base is raised sufficiently.

Moreover, when using the present method, in the event a lateral force is needed in order to get the second mounting screw's head through a mounting hole in the base, it is readily apparent to the installer in what direction the lateral force should be applied. Namely, once the second mounting screw has been screwed into a threaded hole in the mounting bracket by rotating the elongated tool which engages it, the lateral force should be applied to the base in a direction so as to make the elongated tool with its engaged mounting screw be roughly perpendicular to the surface of the mounting bracket.

Having described the invention, it will be readily apparent to those of ordinary skill in the art that the present invention is equally advantageous when mounting a light fixture base to a surface other than a ceiling. Thus, "upward" and "above" are defined herein more broadly than in a dictionary. "Upward" is defined as—a direction toward the mounting surface—and "above" is defined as—a position nearer the mounting surface—. Likewise, "downward" is defined as—a direction away from the mounting surface—and "below" is defined as—a position more remote from the mounting surface—. Further, it will be readily apparent that the elongated tool(s) used in the method can be of various cross-sectional shapes (e.g., circular, triangular, square, pentagonal, hexagonal, etc.), the cross-section need not be the same over the length of the elongated tool(s), and it (they) can be made from various materials, such a extruded plastic, moulded plastic, paper, metal, and so on.

What is claimed is:

1. A method of installing a light fixture, said method comprising the following steps:

(a) insert an elongated tool, having a hollow portion at one end and a head of a mounting screw frictionally engaged by the hollow portion and with a tip end of the mounting screw extending outside the hollow portion, through a mounting hole in a base of a light fixture that is to be mounted to a support bracket of a junction box, as well as through a thermal insulation contained in the base until the tip end emerges above the thermal insulation;

(b) while viewing both the tip end of the mounting screw and the support bracket, manipulate the elongated tool so as to insert the tip end within a threaded hole of the support bracket;

(c) rotate the elongated tool so that the mounting screw engages the threaded hole;

(d) slide the base up along the elongated tool until the mounting hole of the base is above the head of the mounting screw, the base having a mounting slot contiguous to the mounting hole that is larger in width than a shaft portion of the mounting screw but smaller than the head of the mounting screw; and (e) move the base so that the shaft portion of the mounting screw enters the mounting slot.

* * * * *